US010570664B2

(12) United States Patent
Herman et al.

(10) Patent No.: US 10,570,664 B2
(45) Date of Patent: Feb. 25, 2020

(54) WELLBORE REAMING TOOL HAVING SHEAR CUTTERS AND GOUGING CUTTERS

(71) Applicant: Shear Bits, Ltd., Calgary (CA)

(72) Inventors: John James Herman, Cypress County (CA); Carl M. Hoffmaster, Houston, TX (US); Kenneth M. Nevlud, Tomball, TX (US); Jason Kelley, Calgary (CA); Shon Carey, Calgary (CA)

(73) Assignee: Shear Bits, Ltd., Calgary (CA)

( * ) Notice: Subject to any disclaimer, the term of this patent is extended or adjusted under 35 U.S.C. 154(b) by 10 days.

(21) Appl. No.: 15/888,843

(22) Filed: Feb. 5, 2018

(65) Prior Publication Data

US 2019/0040687 A1 Feb. 7, 2019

Related U.S. Application Data

(60) Provisional application No. 62/456,796, filed on Feb. 9, 2017.

(51) Int. Cl.

| | |
|---|---|
| ***E21B 10/26*** | (2006.01) |
| ***E21B 10/567*** | (2006.01) |
| ***E21B 7/28*** | (2006.01) |
| ***E21B 10/28*** | (2006.01) |

(52) U.S. Cl.

CPC ..... *E21B 10/26* (2013.01); *E21B 7/28* (2013.01); *E21B 10/28* (2013.01); *E21B 10/567* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,981,184 | A * | 1/1991 | Knowlton | E21B 10/43 175/397 |
| 8,607,900 | B1 * | 12/2013 | Smith | E21B 10/26 175/323 |
| 2015/0144405 | A1 | 5/2015 | Salvo et al. | |
| 2016/0084010 | A1 * | 3/2016 | Beaton | E21B 10/573 175/432 |

FOREIGN PATENT DOCUMENTS

| | | | |
|---|---|---|---|
| WO | 201707075117 | A1 | 5/2017 |
| WO | 20170132033 | A1 | 8/2017 |
| WO | 20170132052 | A1 | 8/2017 |

OTHER PUBLICATIONS

International Search Report and Written Opinion, International application No. PCTIB2018050680.

* cited by examiner

*Primary Examiner* — Taras P Bemko
*Assistant Examiner* — Ronald R Runyan
(74) *Attorney, Agent, or Firm* — Richard A. Fagin

(57) ABSTRACT

A reaming tool includes a reaming tool body configured to be coupled within a drill string or a string of drilling tools. A plurality of reaming blocks is attached to the reaming tool body at circumferentially spaced apart locations. Each reaming block comprises at least one row of shear cutters and gouging cutters, the gouging cutters in the at least one row disposed rotationally ahead of the shear cutters in the at least one row.

19 Claims, 3 Drawing Sheets

WELLBORE REAMING TOOL HAVING SHEAR CUTTERS AND GOUGING CUTTERS

CROSS REFERENCE TO RELATED APPLICATIONS

Priority is claimed from U.S. Provisional Application No. 62/456,796 filed on Feb. 9, 2017 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of wellbore reaming tools used to enlarge the diameter of a wellbore that has been drilled by a drill bit. More specifically, the disclosure relates to reaming tools having shear cutters and gouging cutters.

U.S. Patent Application Publication No. 2004/0159468 discloses a reaming tool that may be used in a drill string behind a drill bit located at one end of the drill string. The reaming tool disclosed in the '468 publication may provide the ability to enlarge a wellbore drilled by the drill bit to a larger diameter than that drilled by the drill bit. The foregoing reaming tool may have reaming blocks fixedly attached to a reamer tool body, or may have reaming blocks that may be expanded to a selected diameter using any one of a number of well known diametrically expandable mechanisms, such as hydraulic cylinders and associated hydraulic rams.

The reaming tool described in the '468 publication may comprise a plurality of shearing type cutting elements ("shear cutters"), for example and without limitation polycrystalline diamond compact (PDC) cutters. PDC cutters may be configured, for example, by affixing a polycrystalline diamond "table" on a substrate. The substrate may be formed for example, from material such as tungsten carbide or steel having a wear resistant outer layer, such layer made from material such as tungsten carbide. The foregoing configuration of shear cutters is not intended to limit the scope of the term "shear cutter" as used in the present disclosure. Shear cutters may also be made entirely from tungsten carbide or other metal carbide without a diamond table, or may have a cutting table made from other materials such as cubic boron nitride (CBN). Such shear cutters may also be configured in any other manner known for use in shear cutters of fixed cutter drill bits and reaming tools.

In some subsurface earthen formations, reaming a wellbore using a reaming tool having only shear cutters has proven disadvantageous. Such subsurface formations have shown a tendency to cause breakage of the shear cutters. Gouging type cutters are used in drill bits for drilling mine shafts or tunnels, among other uses. Such drill bits are known in the art as "claw" bits, one example of which is sold under the trademark QUI-KLAW, which is a trademark of Drillhead, Inc. Such drill bits are known to be useful in drilling formations such as clay, unconsolidated sand, loose rock and gravel.

U.S. Pat. No. 8,505,634 issued to Lyons et al. describes a drill bit having gouging cutting elements disposed adjacent to shearing cutting elements on a blade on the bit body. The shearing cutting elements have a planar cutting face, while the gouging cutting elements have a non-planar cutting face, e.g., dome shaped or cone shaped, also referred to as "ballistically shaped."

DETAILED DESCRIPTION

Figure 1:
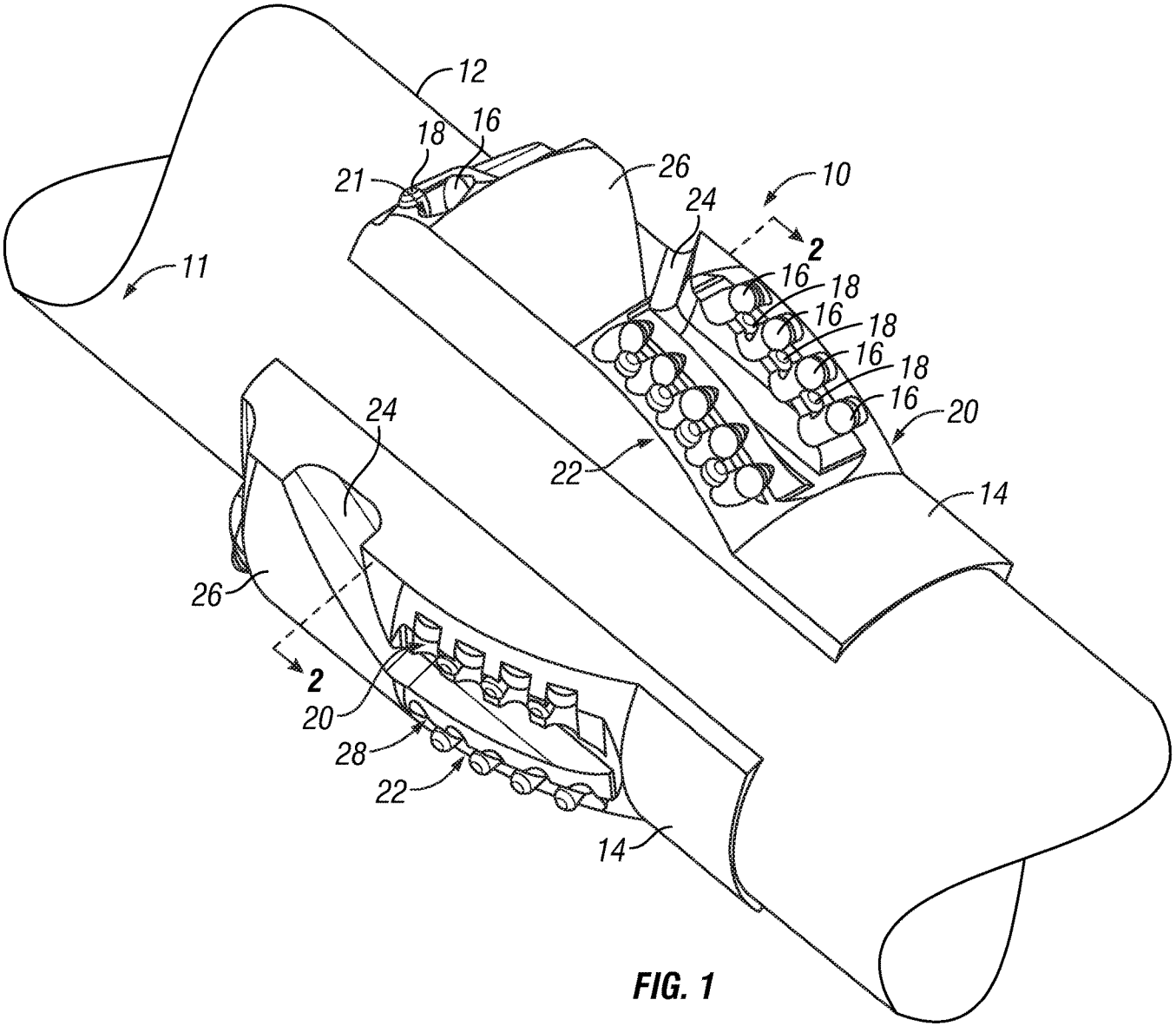
FIG. 1 shows an oblique view of an example embodiment of a reaming tool according to the present disclosure.

FIG. 1 shows an oblique view of an example embodiment of a reaming tool 10 according to the present disclosure. The reaming tool 10 may be made from a reaming tool body 12. The reaming tool body 12 may be made from any material known in the art to be used for connection within a drill string or assembly of drilling tools, including for example and without limitation, steel, monel, and an alloy sold under the trademark INCONEL, which is a registered trademark of Huntington Alloys Corporation, Huntington, W. Va. The reaming tool body 12 may comprise threaded connections (not shown) at its longitudinal ends to enable connection within a drill string or drilling tool assembly. The reaming tool body 12 may be assembled to such a drill string or drilling tool assembly at a selected longitudinal position above a drill bit (not shown) to enable simultaneous drilling and reaming of a subsurface wellbore by rotating the drill string or drilling tool assembly and axially urging the drill string or drilling tool assembly to lengthen the wellbore and contemporaneously enlarge its diameter from the diameter drilled by the drill bit (not shown). In the present example embodiment, the direction of rotation of the reaming tool body 12 is indicated by an arrow at 11.

The reaming tool body 12 may comprise a plurality of reaming blocks 14 disposed about the circumference of the reaming tool body 12. In the present example embodiment, there may be three such reaming blocks 14 (see FIG. 2), disposed at 120 degrees angular circumferential separation from each other. In other embodiments, more or fewer reaming blocks 14 may be used. It is contemplated that a minimum of two reaming blocks 14 separated circumferentially by 180 degrees may be used. In other embodiments, the circumferential separation between reaming blocks 14 may be 360 degrees divided by the number or reaming blocks. In some embodiments, a circumferential surface dimension of each of the reaming blocks 14 may be inversely related to the number of reaming blocks.

The reaming blocks 14 may be made from, for example and without limitation, steel, monel or the INCONEL alloy set forth above. The reaming blocks 14 may have a wear resistant exterior layer such as may be made from metallic carbide, e.g., tungsten carbide. In the present example embodiment, shear cutters 16 and gouging cutters 18 may be arranged in rows and affixed to the reaming blocks 14. In the present example embodiment, each reaming block 14 may comprise a first row 22 and a second row 20 of such shear cutters and gouging cutters, each such row arranged generally along the longitudinal dimension of the reaming tool body 12; in other embodiments, one or each such row of cutters may include some rotational (circumferential) offset with respect to position along the longitudinal dimension of the reaming tool body 12. In the present example embodiment, the second row 20 of cutters may be disposed rotationally behind the first row 22 with reference to the direction of rotation of the reaming tool body 12 during operation of the reaming tool in a wellbore. The first and second rows 22, 20 of cutters may be separated by a junk slot 24 or similar structure in the face of the reaming block 14 to provide a feature to enable reaming tool cuttings to be readily moved away from the reaming block 14 during reaming operations. The reaming tool cuttings may be moved by the flow of drilling fluid or other wellbore fluid circulated through the drill string during drilling and/or reaming operations and consequently lifted out of the wellbore (not shown) to the surface. In the present example embodiment, in each of the first and second row, respectively at 22, 20, of cutters, the gouging cutters 18 may be located rotationally ahead of the shear cutters 16 in such row. Rotationally "ahead" means in the direction of rotation such that the gouging cutters 18 on each row 22, 20 contact and thus cut (ream) the formation before the shear cutters 16. The gouging cutters 18 may each be disposed directly in front of a corresponding shear cutter 16, or may be longitudinally alternated with the shear cutters 16 as shown in FIG. 1. The reaming blocks 14 may define a cutting profile surface 28 in which the diameter subtended by the shear cutters 16 and the gouging cutters 18 increases with respect to longitudinal position along the direction of reaming of the reaming tool 10. Any profile surface known to be used for fixed cutter reaming blocks may be used in various embodiments. The reaming blocks 14 may each define a gage surface 26 proximate a longitudinal upper end (farthest away from the drill bit) of the reaming block 14. The gage surface may serve to stabilize motion of the reaming tool in a wellbore to provide a relatively smooth wellbore interior surface during reaming. At an upper end of one or more of the reaming blocks 14 a backreaming cutter assembly 21 may be provided above the upper end of the gage surface 26. The backreaming cutter assembly 21 may comprise at least one shear cutter 16 and at least one gouging cutter 18 arranged rotationally and longitudinally as in the rows 22, 20 of cutters in the profile 28 part of the reaming block 14.

The gouging cutters 18 may be configured to be mounted directly to the reaming block 14 in corresponding pockets (not shown separately) such as by brazing. The gouging cutters 18 in some embodiments may be mounted to the reaming block 14 so as to be rotatable within the respective mounting pocket. The shear cutters 16 may be affixed to the reaming block 14 such as by brazing or other technique known for affixing shear cutters to a cutting structure (such as a bit body or blade on a bit body). The shear cutters may be PDC cutters or other type of shear cutters known in the art. The gouging cutters 18 may be substantially conically or ballistically shaped, and may be made from steel covered with a wear resistant material such as metal carbide, e.g., tungsten carbide, or may be made entirely from metal carbide, e.g., tungsten carbide. In some embodiments, some or all of the gouging cutters 18 may be made from or may be covered by a layer of "ultra hard" material such as polycrystalline diamond (PCD) or cubic boron nitride (CBN). In some embodiments, some or all of the gouging cutters 18 may be made in the form of a diamond monolith. In some embodiments, some or all of the gouging cutters 18 may comprise impregnated diamond in the body of the gouging cutter(s) 18, which may be made from a different material such as tungsten carbide.

Figure 2:
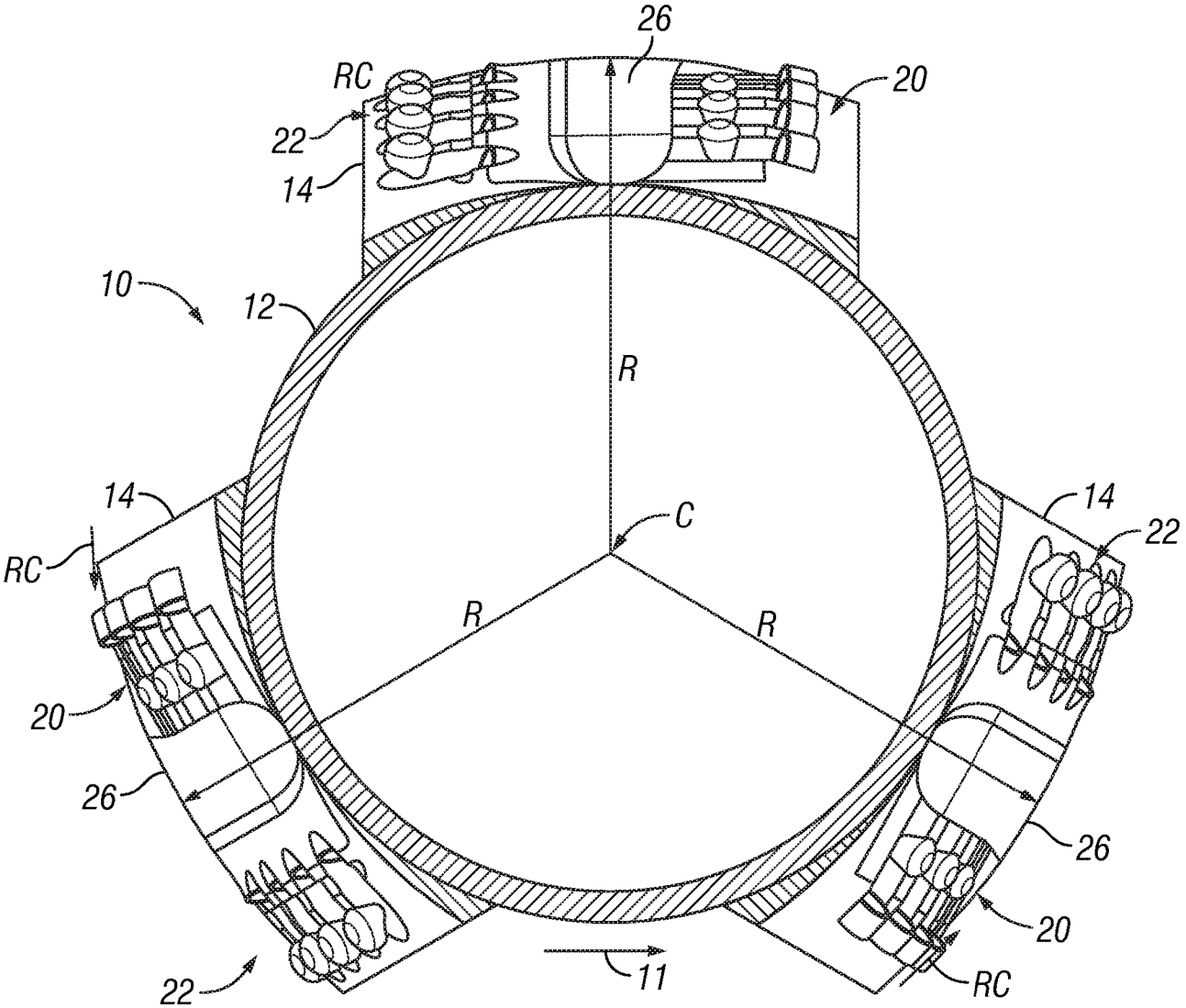
FIG. 2 shows a cross-sectional view of the example embodiment of a reaming tool shown in FIG. 1.

FIG. 2 shows a cross section of the reaming tool 10 along line 2-2' in FIG. 1. A gage surface 26 of each reaming block 14 is arranged to be disposed at a selected radius R from the center of rotation C of the reaming tool body 12. A radius of curvature of each gage surface 26 may be selected to match the selected radius R defined by each gage surface 26. The present example embodiment comprises three reaming blocks 14. As explained above with reference to FIG. 1, more or fewer reaming blocks 14 may be used in other embodiments to equal effect. The direction of rotation is indicated in FIG. 2 at 11.

Figure 3:
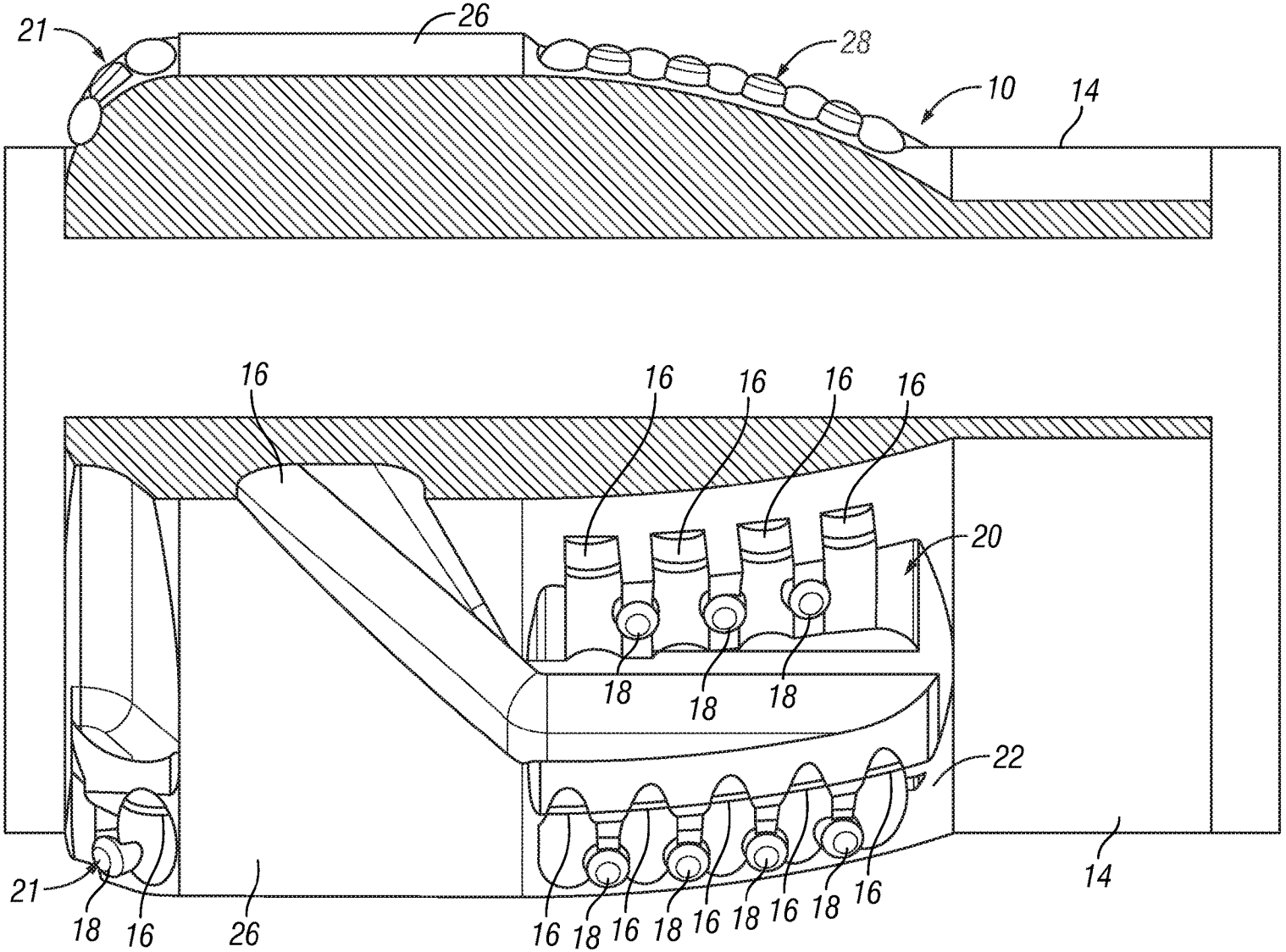
FIG. 3 shows a side view of the example embodiment of a reaming tool as shown in FIG. 1 and FIG. 2.

FIG. 3 shows a side view of the reaming tool 10 wherein a view of some of the features of the reaming blocks 14 are more clearly observable. The cutting profile 28 may be readily observed in the side view of the reaming block 14 in the upper part of FIG. 3, as well as a profile subtended by a backreaming cutter assembly 21 above the top of the gage surface 26. One example of a shape of the junk slot 24 may be observed in the lower reaming block 14 shown in FIG. 3. The relative rotational and longitudinal positions of the shear cutters 16 and the gouging cutters 18 in the first row 22 and the second row 20 may be better observed in the lower part of FIG. 3.

As explained above, the number of shear cutters 16 and gouging cutters 18 in any row (22 or 20, respectively), and their relative longitudinal positions with respect to each other may be selected to provide optimized reaming performance. Although the present example embodiment contemplates using two rows of shear cutters 16 and two rows gouging cutters 18 on each reaming block 14, more or fewer rows of cutters may be used in other embodiments. For purposes of defining the scope of the present disclosure, it is only necessary that for any single row of cutters, wherein a "row" is defined as longitudinally substantially contiguously arranged shear and gouging cutters along the longitudinal dimension of the reaming block 14, in any row, the gouging cutters 18 are disposed rotationally ahead of the shear cutters 16.

Reaming tools made according to the present disclosure have demonstrated ability to drill through vary coarse, unconsolidated sediments, with rock fragments in the centimeter size range, substantially without failure of either the gouging cutters or the shear cutters.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A reaming tool, comprising:

a reaming tool body configured to be coupled within a drill string or a string of drilling tools;

a plurality of reaming blocks attached to the reaming tool body at circumferentially spaced apart locations; and wherein each reaming block comprises at least one row of shear cutters and at least one row of gouging cutters, the gouging cutters in the at least one row disposed rotationally ahead of the shear cutters in the at least one row, the gouging cutters being disposed at least one of, (i) longitudinally directly ahead of the shear cutters and (ii) longitudinally alternating between adjacent shear cutters.

2. The reaming tool of claim 1 wherein the gouging cutters are disposed longitudinally between adjacent shear cutters.

3. The reaming tool of claim 1 wherein each reaming block comprises two rows of shear cutters and two rows of gouging cutters.

4. The reaming tool of claim 3 wherein the two rows of shear cutters and gouging cutters are rotationally separated by a junk slot.

5. The reaming tool of claim 1 wherein the at least one row of shear cutters and at least one row of gouging cutters define a cutting profile having an increasing diameter with respect to a longitudinal position of the cutters along the cutting profile.

6. The reaming tool of claim 1 wherein the reaming blocks comprise a gage surface longitudinally proximate a longitudinal end farthest away from a drill bit.

7. The reaming tool of claim 6 further comprising at least one backreaming cutter assembly disposed longitudinally above the longitudinal end farthest away from the drill bit on at least one reaming block.

8. The reaming tool of claim 7 wherein the at least one backreaming cutter assembly comprises at least one backreaming shear cutter and at least one backreaming gouging cutter, the at least one backreaming gouging cutter disposed rotationally ahead of the at least one backreaming shear cutter on the at least one backreaming cutter assembly.

9. The reaming tool of claim 1 wherein the plurality of reaming blocks are fixedly mounted to the reaming tool body.

10. The reaming tool of claim 1 wherein the shear cutters comprise polycrystalline diamond compact cutters.

11. The reaming tool of claim 1 wherein the shear cutters are brazed to at least one reaming block.

12. The reaming tool of claim 1 wherein the gouging cutters are rotatably mounted to at least one reaming block.

13. The reaming tool of claim 1 wherein the gouging cutters are substantially conically or ballistically shaped.

14. The reaming tool of claim 1 wherein the gouging cutters are made from tungsten carbide.

15. The reaming tool of claim 1 wherein the gouging cutters are made at least in part from polycrystalline diamond and/or cubic boron nitride.

16. The reaming tool of claim 1 wherein at least one of the reaming blocks comprises a backreaming cutter assembly.

17. The reaming tool of claim 1 wherein the plurality of reaming blocks are circumferentially separated from each other around the reaming tool body by an angle defined by 360 degrees divided by a number of the reaming blocks attached to the reaming tool body.

18. The reaming tool of claim 1 wherein at least one of the gouging cutters comprises diamond monolith.

19. The reaming tool of claim 1 wherein at least one of the gouging cutters comprises diamond impregnated material.

* * * * *